US005761943A

United States Patent [19]

Bläsius

[11] Patent Number: 5,761,943

[45] Date of Patent: Jun. 9, 1998

[54] METHOD OF AND ARRANGEMENT FOR MAKING HELICAL SPRINGS FROM BICONICAL WIRE

[75] Inventor: Alfred Bläsius, Kleinblittersdorf, Germany

[73] Assignee: Allevard Federn GmbH, Völklingen, Germany

[21] Appl. No.: 797,595

[22] Filed: Feb. 7, 1997

[30] Foreign Application Priority Data

Feb. 7, 1996 [DE] Germany ..... 196 04 408.1

[51] Int. Cl.[6] ..... B21F 11/00; B21F 3/02

[52] U.S. Cl. ..... 72/132; 72/135; 72/19.6

[58] Field of Search ..... 72/132, 135, 129, 72/15.5, 16.2, 16.4, 17.3, 18.2, 16.8, 18.6, 19.6; 149/124, 139, 140; 83/371, 907

[56] References Cited

U.S. PATENT DOCUMENTS 3,318,180 5/1967 Bauman et al. ..... 83/371

4,918,958 4/1990 Glomb et al. ..... 72/135

*Primary Examiner*—Lowell A. Larson

*Assistant Examiner*—Rodney Butler

*Attorney, Agent, or Firm*—Henry M. Feiereisen

[57] ABSTRACT

A method and arrangement of making helical springs from a wire, includes a winding machine for coiling the wire strand to a finished spring. Disposed upstream of the winding machine is a wire gage for measuring a diameter of the wire strand at a predetermined spot of a conical section of the advancing wire strand and producing a control signal commensurate with the registered diameter. The winding machine includes a cutting tool which is actuated in response to the registered control signal, with a new spring coiling cycle being initiated at the same time.

10 Claims, 2 Drawing Sheets

METHOD OF AND ARRANGEMENT FOR MAKING HELICAL SPRINGS FROM BICONICAL WIRE

BACKGROUND OF THE INVENTION

The present invention refers to a method of and arrangement for making helical springs from a wire strand, in particular from biconical wire.

Rather than employing wires of constant diameter, current manufacturing processes for making helical springs typically use wires that exhibit periodically changing diameters over sections of constant length. Such wires are generally called "wires with biconical sequences", and results in helical springs which exhibit progressive spring characteristic, and in particular allows making of barrel springs.

An example of a conventional biconical sequence of a wire for making helical springs is known from German Pat. No. DE 41 29 172 and is shown in FIG. 1. The wire has a plastically bent biconical sequence 14 with a central, cylindrical section 15 defined by a greatest diameter and exhibiting an arc defined by an angle of center a and radius of curvature $R_1$. Connected adjacent to the ends of the arched section 15 are conical sections 16 and 17, respectively, which are plastically bent to a marginal diameter $d_x$ defined by an angle of center $\alpha$ and radius of curvature $R_1'$, whereby the radius of curvature $R_1$ is greater than the radius of curvature $R_1'$ so that the conical sections 16, 17 exhibit a smaller curve than the central section 15. The conical sections 16, 17 terminate in cylindrical sections 1 and 5, respectively, to conclude the sequence 14. The sequence 14 thus has the curved section 15 and sections 16, 17 which are plastically deformed up to the marginal diameter $d_x$, and non-plastically deformed sections composed of the adjoining remaining areas of the sections 16 and 17 and the cylindrical sections 17, 18. During winding operation, the non-plastically deformed sections are elastically bent into a straightened configuration which is defined by a radius of curvature $R_2=\infty$.

Helical springs on the basis of such biconical wires are typically made by automatic winding machines which generally include a cutting tool for separating the formed helical spring from the biconical wire. Typically, the biconical wire is provided at the narrowest section with a compensation or transition piece that is positioned between successive wire sequences and is formed with an indentation (notch) for triggering a signal by which the cutting tool is controlled to separate the wire. Thus, the spring coiling program includes two cutting phases, i.e. a first cutting phase in which the spring is separated from the wire, and a second cutting phase in which the compensation piece with the indentation is separated from the wire. Length fluctuations between repeating wire sequences can thus be compensated, and the spring coiling program can be restarted after the second cutting phase in response to the registered indentation. This type of control has several drawbacks:

1) The necessity to provide a separate compensation piece with indentation.

2) The cutting tool must cut twice because the indentation must be removed from the wire. This results in a material loss.

3) In particular, when processing very thin wires, the position of the indentations is very difficult to detect. This results in errors in conjunction with the control of the cutting tool.

4) The provision of indentations subjects the wire to a risk of fracture, especially when manufacturing helical springs from thin, pre-tempered wires.

German Pat. No. DE 40 34 793 A1 describes a triggering process for operating a flying cutting tool, in which the operation of the flying cutting tool which travels; conjointly with the advancing workpiece is based on a detection by sensors of the entire contour of the workpiece being cut.

SUMMARY OF THE INVENTION

It is an object of the present invention to provide an improved method of and arrangement for making helical springs from a wire strand, obviating the afore-stated drawbacks.

In particular, it is an object of the present invention to provide an improved method of and arrangement for making helical springs from wire by allowing a control of the winding machine without experiencing any of the afore-stated drawbacks.

These objects and others which will become apparent hereinafter are attained in accordance with the present invention by disposing upstream of the winding machine a wire gage for measuring a diameter of the wire strand at a predetermined spot of a conical section of the advancing wire strand, and producing a control signal commensurate with the registered diameter, and by separating the spring formed in the winding machine from the wire strand and commencing a new spring coiling cycle in response to the registered control signal.

Preferably, the periodically repeating conical section of the wire strand is formed as ramp-like area flaring outwardly in traveling direction of the wire strand.

According to another feature of the present invention, the separation of the finished spring is effected by a cutting tool which is associated to the winding machine and actuated in response to a detection of the control signal.

According to yet another feature of the present invention, the control signal may be transmitted to a processor associated to the winding machine for operating the cutting tool to separate the formed helical spring. The control signal may also be utilized for control of a heating unit positioned upstream of the wire gage for pre-heating the wire strand, and/or for control of a wire-marking device positioned upstream of the wire gage for providing a mark on the later formed spring.

Through the provision of a wire gage that measures the diameter at a discrete, particular spot along the conical section of the wire strand, the winding machine can be controlled without encountering any damage of the wire surface, so that the overall spring coiling process can be executed in a cost-efficient manner. The product safety is guaranteed and any risk of wire fracture is eliminated. Moreover, wire material can be saved because modern wire peeling machines allow sufficiently precise length tolerances of the biconical sequences so that the use of compensation pieces can substantially be eliminated.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
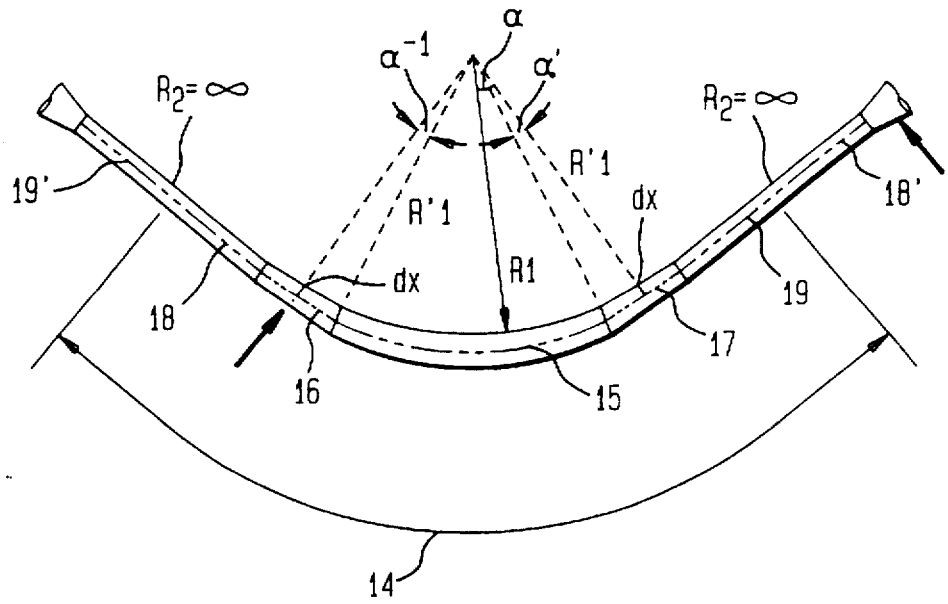
FIG. 1 (PRIOR ART)
FIG. 1 is a schematic illustration of a conventional wire exhibiting a biconical sequence.
Figure 2:
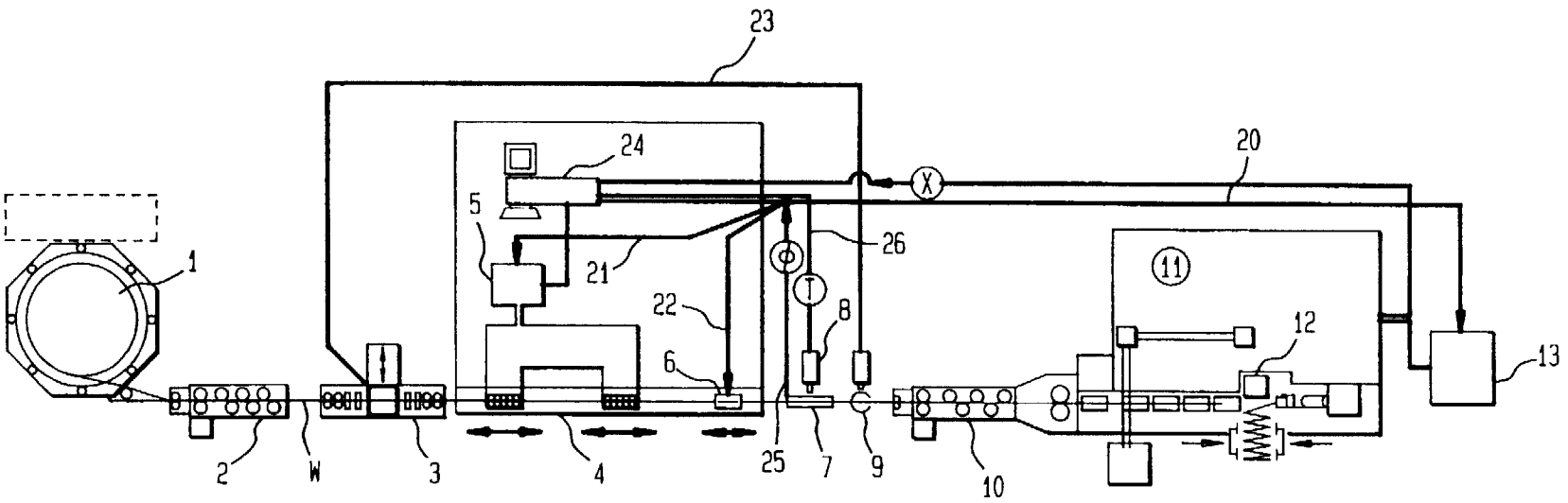
FIG. 2 is a schematic, simplified illustration of a process of manufacturing helical springs from a biconical wire strand.

Turning now to the drawing, and in particular to FIG. 2, there is shown a process of manufacturing helical springs from a biconical wire strand as exemplified in FIG. 1. The biconical wire is made from a wire strand W supplied from a feed spool 1 and passing a straightening device 2 in form of a plurality of superimposed rollers for straightening the strand of wire. The wire strand W then travels through an eddy current tester 3 for detecting cracks and subsequently is advanced through a pre-heating device 4 which is supplied with electric energy from a generator 5. The wire than passes a wire-marking device 6 where the marking of the later produced spring is provided.

The biconical wire W then passes a wire gage 7 which measures the diameter in the area of the conical section 16, and subsequently travels past a temperature measuring device 8. Reference numeral 9 designates a color marking apparatus for coloring the cracks in response to a signal transmitted by the eddy current tester 3 via a line 23 upon detection of a crack. The biconical wire W is then aligned again by a straightening device 10 before entering an automatic winding machine 10 for coiling the wire W to assume a helical spring shape. The winding machine 11 includes a stationary cutting tool or shearing device 12 for separating the finished helical springs from the wire strand W.

The overall process is monitored and controlled by a control unit which includes a processor 13 and a display unit 24 and receives a control signal or trigger pulse from the wire gage 7 via line 25 commensurate with the diameter at a particular spot of the wire strand, preferably a particular spot on the ramp-like, ascending conical section of the wire, i.e. in the example of FIG. 1, the diametrical value of a particular spot along the conical section 16, when the wire strand W travels past the wire gage 7. In response to the control signal from the wire gage 7, the processor 13 controls the winding machine 11 via line 20 and in particular triggers operation of the cutting tool 12 to separate the formed helical spring from the wire strand W. Thus, a particular spot of the wire, preferably a particular or distinct spot on the ramp-like, ascending conical section which is monitored by the wire gage 7 triggers the cutting operation of the cutting tool 12.

The control unit further processes an information signal which is transmitted by the temperature measuring device 8 and is commensurate with an actual temperature value of the advancing wire W. This information signal is transmitted via line 26 to the control unit and processed to allow suitable adjustment of the pre-heater 4 through appropriate control of the energy output of the generator 5 via line 21. In addition, it is also possible to utilize the control signal transmitted by the wire gage 7 for controlling the operation of the pre-heating unit 4 via line 21 and the wire-marking device 6 via line 22.

The operation of the cutting tool 12 is thus based on the determination of the diameter at a particular spot of the conical wire section 16 to produce a respective control signal which can be used directly or indirectly to actuate the cutting tool 12. In the latter case, i.e. upon indirect control of the cutting tool 12, the control signal is processed by the processor 13 that is associated to the winding machine 11.

While the invention has been illustrated and described as embodied in a method of and arrangement for making helical springs from biconical wire, it is not intended to be limited to the details shown since various modifications and structural changes may be made without departing in any way from the spirit of the present invention.

What is claimed as new and desireed to be protected by Letters Patent is set forth in the appended claims.

What is claimed is:

1. A method of making helical springs from biconical wires, comprising the steps of:

supplying a biconical wire strand exhibiting different well-defined diameters corresponding to a well-defined spring with recurring conical sections;

measuring a diameter of the wire strand at a predetermined spot of such a conical section of the advancing wire strand and producing a control signal commensurate with the registered diameter;

conveying the wire strand to a winding machine for coiling the wire strand to a finished spring; and separating the finished spring from the wire strand and commencing a next spring coiling cycle in response to the registered control signal.

2. The method of claim 1, wherein the periodically recurring conical section exhibits a ramp-like area in traveling direction of the wire strand.

3. The method of claim 1, wherein said separating step is triggered by the control signal to actuate a cutting tool associated to the winding machine.

4. The method of claim 1 wherein said measuring step includes transmitting the control signal to a processor operatively connected to the winding machine for effecting said separating step.

5. The method of claim 1, and further comprising the step of preheating the wire strand upstream of said measuring step in response to the registered control signal.

6. The method of claim 1, and further comprising the step of marking the wire strand with identifying data in response to the registered control signal.

7. An arrangement for making helical springs from biconical wires comprising:

a feeding unit for supplying a bi-conical wire strand exhibiting well-defined different diameters corresponding to a well-defined spring with recurring conical sections;

a wire gage for measuring a diameter of the wire strand at a predetermined spot of such a conical section of the advancing wire strand and producing a control signal commensurate with the registered diameter; and a winding machine positioned downstream of the wire gage for coiling the wire strand to a finished spring, said winding machine including a cutting tool for separating the finished spring from the wire strand, and a processor receiving the control signal from the wire gage for triggering operation of the cutting tool and initiation of a next spring coiling cycle in response to the inputted control signal.

8. The arrangement of claim 7 wherein the periodically recurring conical section exhibits a ramp-like area in traveling direction of the wire strand.

9. The arrangement of claim 7, and further comprising a preheating device arranged upstream of the wire gage for pre-heating the advancing wire strand in response to the registered control signal.

10. The arrangement of claim 7, and further comprising a wire-marking unit operatively connected to the wire gage for marking the wire strand with identifying data in response to the registered control signal.

* * * * *